US005085164A

United States Patent [19]

Whitton

[11] Patent Number: 5,085,164

[45] Date of Patent: Feb. 4, 1992

[54] SWIM PLATFORM FOR A PONTOON BOAT

[75] Inventor: David R. Whitton, Paragould, Ark.

[73] Assignee: Lary M. Whitton, West Memphis, Ark. ; a part interest

[21] Appl. No.: 642,865

[22] Filed: Jan. 17, 1991

[51] Int. Cl.[5] ..... B63B 17/00

[52] U.S. Cl. ..... 114/362; 114/61

[58] Field of Search ..... 114/61, 362, 343; 14/71.1

[56] References Cited

U.S. PATENT DOCUMENTS 4,993,341 2/1991 Merkel ..... 114/61

FOREIGN PATENT DOCUMENTS 652106 3/1929 France ..... 114/362

57-99492 6/1982 Japan ..... 114/362

*Primary Examiner*—Ed Swinhart

*Attorney, Agent, or Firm*—Walker & McKenzie

[57] ABSTRACT

A platform assembly for use with a pontoon boat. The platform assembly includes a substantially flat platform member for allowing users to stand, sit, and/or step thereon. The platform assembly includes track structure for mounting the platform member to the boat and for allowing the platform member to move between a first, stored position above the body of water and a second, in-use position adjacent the body of water.

16 Claims, 3 Drawing Sheets 165
163
2
17
23
13
151
3
167
59
63
19
169
25
157
29
41
77
55
37
2
35
11
31
43
37
27
33
45
3
15
81
57

4
13
135
17
19
61
21
67
27
153
101
162
97
33
155
151
47
45
103
65
15
55
59
35
63
95
99
4
11
147
29

13
17
19
21
143
27
119
159
115
33
157
79
11
57
83
113
57
77
149
161
117
162
37
81
15
45
47
39
35
85
121
31

FIG. 4
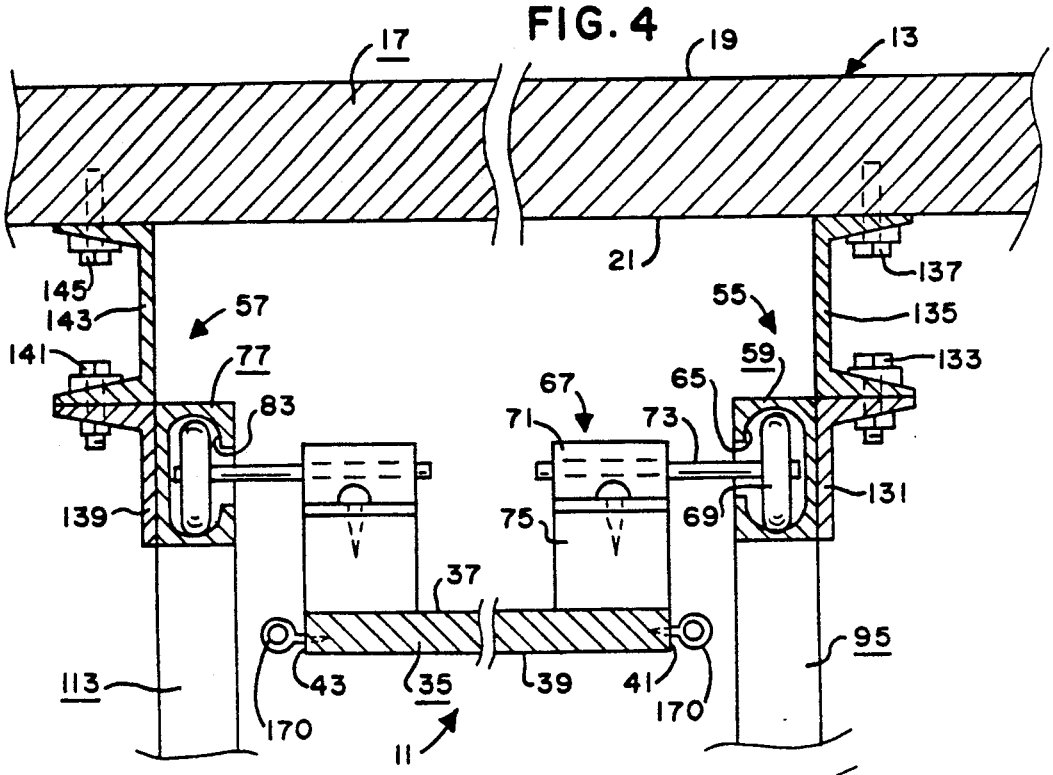
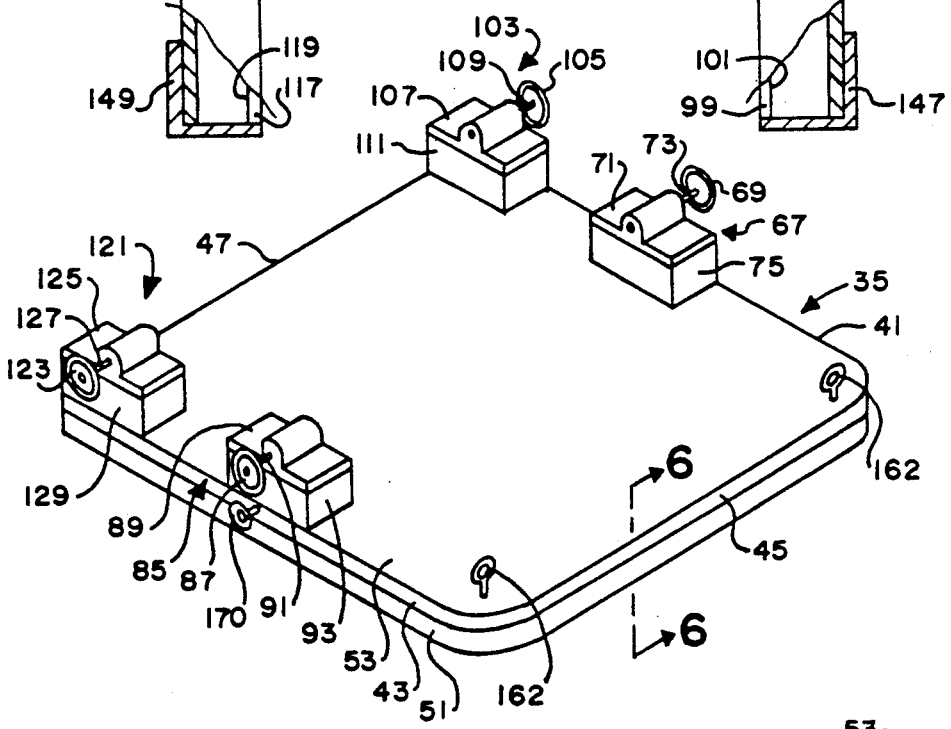
FIG. 5
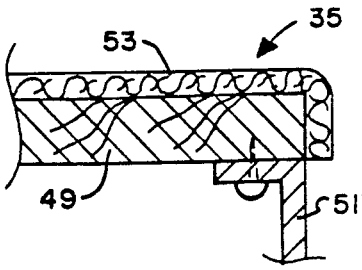
FIG. 6

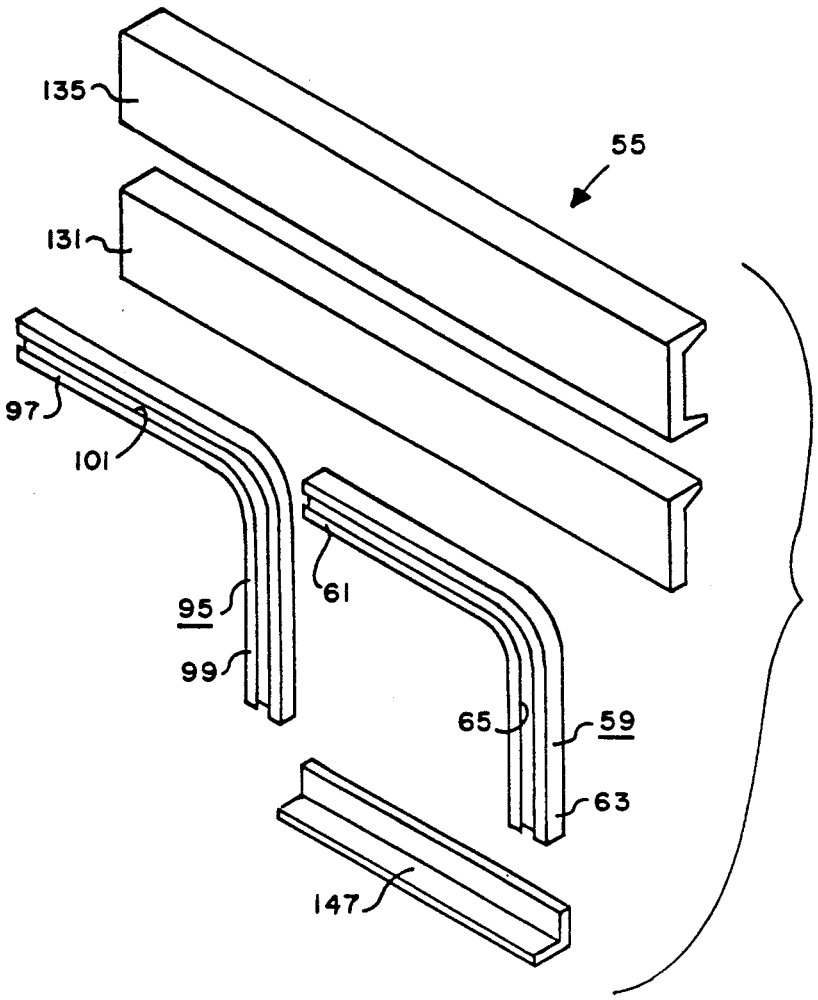
FIG.7
FIG.8
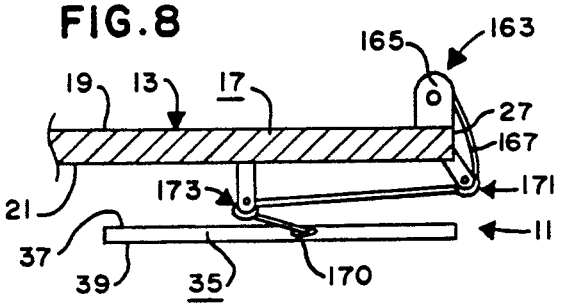
FIG.9
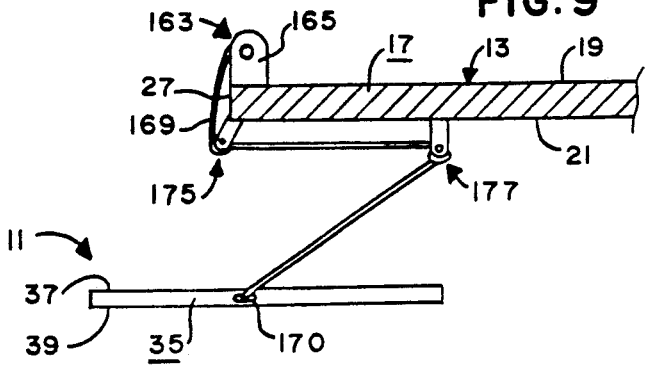

SWIM PLATFORM FOR A PONTOON BOAT

BACKGROUND OF THE INVENTION

1. Field of the Invention

The present invention relates, in general, to a platform assembly for being attached to a pontoon boat for providing a platform adjacent the surface of the water.

2. Information Disclosure Statement

Pontoon boats typically include a substantially flat deck, pontoons attached to and depending from the opposite sides of the deck to cause the deck to float a distance above the surface of a body of water. The distance the top of the deck is held above the surface of the body of water depends on the overall design of the pontoon boat, etc. However, the top of the deck of most pontoon boats is normally held a distance above the surface of the body of water that is too great for easy ingress and egress between the pontoon boat and the body of water. Thus, if ingress and egress between the pontoon boat and the body of water is desired, the prior art teaches attaching a ladder to the deck of the pontoon boat to allow users to climb between the deck of the pontoon boat and the body of water.

Nothing in the prior art discloses or suggests a platform assembly including a platform member, and track means for mounting the platform member to a boat and for allowing the platform member to move between a first position above a body of water and a second position adjacent the body of water.

SUMMARY OF THE INVENTION

The present invention is directed toward providing an accessory for pontoon boats and the like that provides a convenient platform for standing, sitting, or stepping without adversely affecting the operation of the boat.

The platform assembly of the present invention includes a platform member; and track means for mounting the platform member to a boat and for allowing the platform member to move between a first position above a body of water and a second position adjacent the body of water.

BRIEF DESCRIPTION OF THE DRAWINGS

FIG. 4 is an enlarged sectional view substantially as taken on line 4—4 of FIG. 2 with portions thereof broken away for clarity.

FIG. 5 is a perspective view of a platform member of the platform assembly of the present invention.

FIG. 6 is an enlarged sectional view substantially as taken on line 6—6 of FIG. 5 with portions thereof broken away for clarity.

FIG. 7 is an exploded perspective view of a track means of the platform assembly of the present invention with portions thereof omitted for clarity.

FIG. 8 is a somewhat diagrammatic view similar to FIG. 2 but showing portions of a winch means of the platform assembly of the present invention and with certain portions omitted for clarity.

FIG. 9 is a somewhat diagrammatic view similar to FIG. 3 but showing portions of the winch means and with certain portions omitted for clarity.

DESCRIPTION OF THE PREFERRED EMBODIMENT

Figure 1:
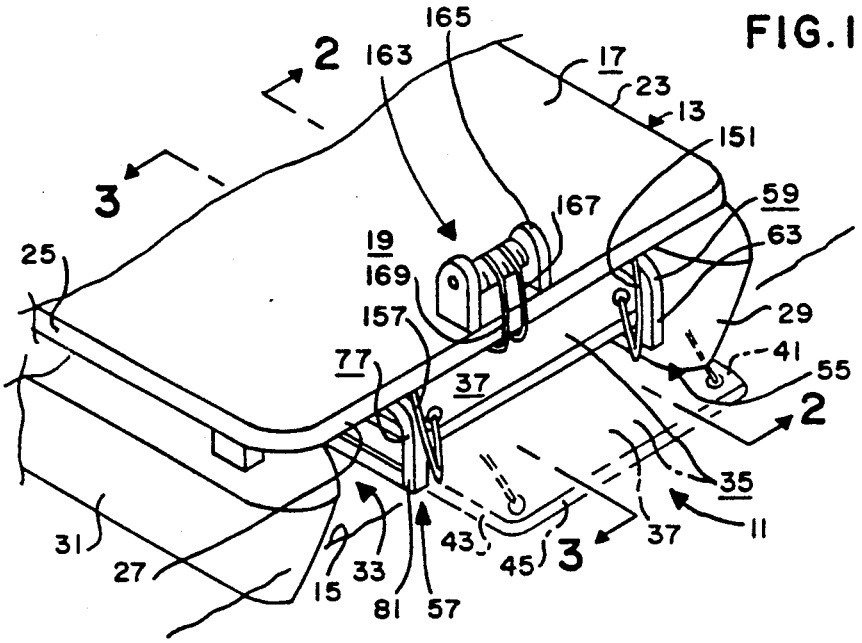
FIG. 1 is a perspective view of the bow end of a pontoon boat with the platform assembly of the present invention mounted thereto and shown in a first, stored position in solid lines and in a second, in-use position in broken lines.
Figure 2:
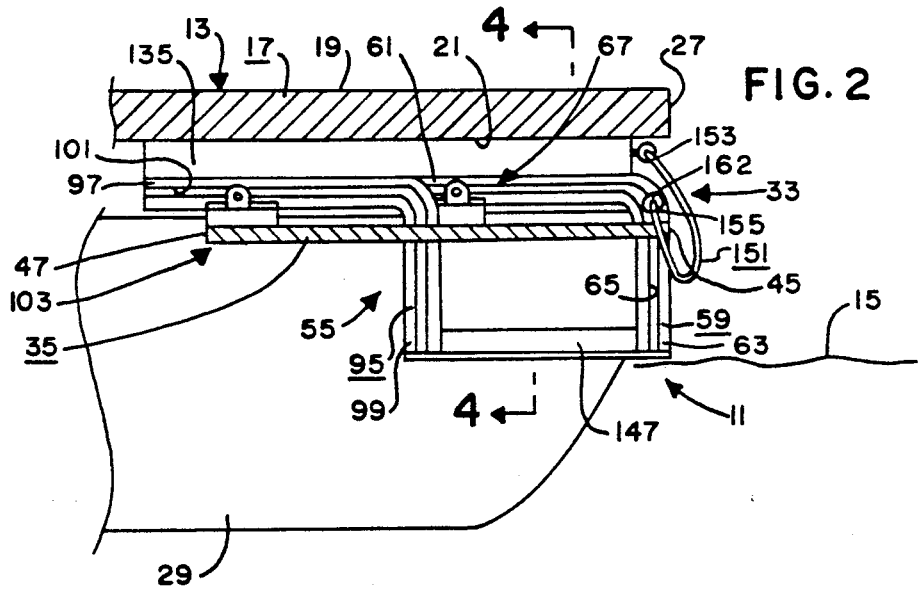
FIG. 2 is an enlarged sectional view substantially as taken on line 2—2 of FIG. 1.
Figure 3:
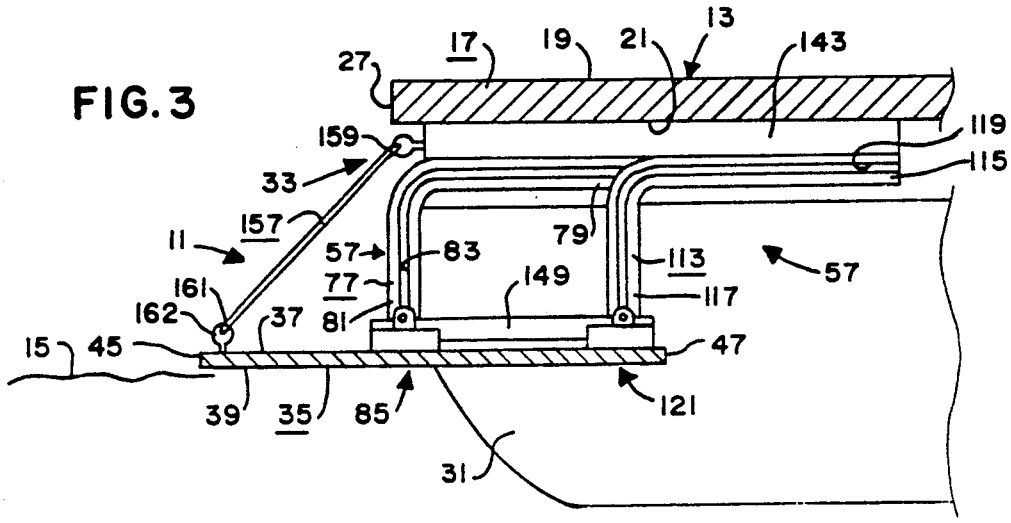
FIG. 3 is an enlarged sectional view substantially as taken on line 3—3 of FIG. 1 but with the platform assembly shown in the second, in-use position.

The preferred embodiment of the platform assembly 11 of the present invention is used with a pontoon boat 13 for floating upon a body 15 of water. The pontoon boat 13 preferably includes a deck member 17 having a top 19, an underside 21, a first side edge 23, a second side edge 25, and a front end 27. The pontoon boat 13 preferably includes a first pontoon 29 attached to and depending from the first side edge 23 of the deck member 17, and a second pontoon 31 attached to and depending from the second side edge 25 of the deck member 17. The pontoons 29, 31 cause the deck member 17 to float a distance above the surface of the body 15 of water whereby an open space 33 is formed between the first and second pontoons 29, 31, the underside 21 of the deck member 17, and the surface of the body 15 of water (see FIGS. 1–3) as will now be apparent to those skilled in the art. The distance the top 19 of the deck member 17 is held above the surface of the body 15 of water depends on the overall design of the pontoon boat 13, etc., as will now be apparent to those skilled in the art. However, the top 19 of the deck member 17 of a typical pontoon boat 13 is normally held a distance above the surface of the body 15 of water that is too great for easy ingress and egress between the pontoon boat 13 and the body 15 of water. Thus, a typical pontoon boat 13 may include a ladder or the like (not shown) for allowing persons to climb between the top 19 of the deck member 17 and the body 15 of water. The platform assembly 11 of the present invention provides a support for being positioned adjacent the surface of the body 15 of water to allow one or more persons to stand, sit or step thereon and allow easy ingress and egress between the pontoon boat 13 and the body 15 of water, etc., as will now be apparent to those skilled in the art without adversely affecting the operation of the pontoon boat 13.

The platform assembly 11 includes a platform member 35. The platform member 35 preferably consists of a substantially flat, rigid structure having a top 37, an underside 39, a first side edge 41, a second side edge 43, a front end 45, and a rear end 47. The platform member 35 is movable between a first or stored position as shown in solid lines in FIGS. 1, 2 and 8 and a second or in-use position as shown in broken lines in FIG. 1 and solid lines in FIGS. 3 and 9. When in the first or stored position, the platform member 35 is located completely above the surface of the body 15 of water and preferably completely within the open space 33 formed between the first and second pontoons 29, 31, the underside 21 of the deck member 17, and the surface of the body 15 of water. When in the second or in-use position, the platform member 35 is located adjacent the surface of the body 15 of water with at least a portion of the front end 45 thereof extending outward of the front end 27 of the deck member 17 of the pontoon boat 13 to thus allow a person to easily stand, sit or step thereon when moving between the top 19 of the deck member 17 and the body 15 of water, etc., as will now be apparent to those skilled in the art. The specific size, shape and construction of the platform member 35 may vary as will now be apparent to those skilled in the art. Thus, for an average size pontoon boat 13, the platform member 35 may consist of a 4 foot by 4 foot square of ½ inch treated plywood 49 with at least the forward corners thereof rounded and with a metal reinforcing frame 51 bolted or otherwise fixedly attached to the lower edge thereof. The plywood 49 may be covered with carpet 53 or the like as clearly shown in FIG. 6.

The platform assembly 11 includes track means for mounting the platform member 35 to the boat 13 and for allowing the platform member 35 to move between the first or stored position and the second or in-use position. More specifically, the platform assembly 11 preferably includes first track means 55 for mounting the first side edge 41 of the platform member 35 to the boat 13 and second track means 57 for mounting the second side edge 43 of the platform member 35 to the boat 13.

The first track means 55 preferably includes a first track member 59 having a first end 61 for being attached to the underside 21 of the deck member 17 of the pontoon boat 13 and having a second end 63. The first end 61 of the first track member 59 is preferably higher than the second end 63 thereof when attached to the deck member 17. More specifically, the first track member 59 preferably includes a 90 degree bend between the first and second ends 61, 63 thereof whereby the first end 61 thereof is substantially horizontal and the second end 63 thereof is substantially vertical when the first track member 59 is attached to the underside 21 of the deck member 17 and the pontoon boat 13 is properly floating on the body 15 of water. The first track member 59 preferably has a C-shaped raceway 65 (see, in general, FIG. 4) for reasons which will hereinafter become apparent. The specific construction of the first track member 59 may vary as will now be apparent to those skilled in the art. The first track member 59 preferably consists of a track portion of a typical over-head garage door assembly or the like.

The first track means 55 also preferably includes a first follower means 67 attached to the first side edge 41 of the platform member 35 for being guided by the first track member 59 between the first and second ends 61, 63 thereof. The first follower means 67 preferably includes a roller 69 for being rollably positioned, held and guided within the C-shaped raceway 65 of the first track member 59, a mounting bracket 71 for being fixedly attached to the top 37 of the platform member 35 adjacent the first side edge 41 thereof, and an axle 73 for joining the roller 69 to the mounting bracket 71 (see, in general, FIG. 4). A spacer block 75 is preferably mounted between the mounting bracket 71 and the top 37 of the platform member 35 (see, in general, FIG. 4) for spacing the top 37 of the platform member 35 below the axle 73, etc. The specific construction of the first follower means 67 may vary as will now be apparent to those skilled in the art. The first follower means 65 preferably consists of a standard follower means of a typical overhead garage door or the like.

The second track means 57 preferably includes a first track member 77 having a first end 79 for being attached to the underside 21 of the deck member 17 of the pontoon boat 13 and having a second end 81. The first end 79 of the first track member 77 is preferably higher than the second end 81 thereof when attached to the deck member 17. More specifically, the first track member 77 preferably includes a 90 degree bend between the first and second ends 79, 81 thereof whereby the first end 79 thereof is substantially horizontal and the second end 81 thereof is substantially vertical when the first track member 77 is attached to the underside 21 of the deck member 17 and the pontoon boat 13 is properly floating on the body 15 of water. The first track member 77 is preferably substantially identical to the first track member 59 and preferably has a C-shaped raceway 83 for reasons which will hereinafter become apparent. The specific construction of the first track member 77 may vary as will now be apparent to those skilled in the art. The first track member 77 preferably consists of a track portion of a typical over-head garage door assembly or the like.

The second track means 57 also preferably includes a first follower means 85 attached to the second side edge 43 of the platform member 35 for being guided by the first track member 77 between the first and second ends 79, 81 thereof. The first follower means 85 is preferably substantially identical to the first follower means 67 and preferably includes a roller 87 for being rollably positioned, held and guided within the C-shaped raceway 83 of the first track member 77, a mounting bracket 89 for being fixedly attached to the top 37 of the platform member 35 adjacent the second side edge 43 thereof, and an axle 91 for joining the roller 87 to the mounting bracket 89. A spacer block 93 is preferably mounted between the mounting bracket 71 and the top 37 of the platform member 35 for spacing the top 37 of the platform member 35 below the axle 91, etc. The specific construction of the first follower means 85 may vary as will now be apparent to those skilled in the art. The first follower means 85 preferably consists of a standard follower means of a typical overhead garage door or the like.

The first track means 55 preferably includes a second track member 95 having a first end 97 for being attached to the underside 21 of the deck member 17 of the pontoon boat 13 substantially directly behind the first track member 59 (see FIG. 2) and having a second end 99. The first end 97 of the second track member 95 is preferably higher than the second end 99 thereof when attached to the underside 21 of the deck member 17. More specifically, the second track member 95 preferably includes a 90 degree bend between the first and second ends 97, 99 thereof whereby the first end 97 thereof is substantially horizontal and the second end 99 thereof is substantially vertical when the second track member 95 is attached to the underside 21 of the deck member 17 and the pontoon boat 13 is properly floating on the body 15 of water. The second track member 95 is preferably substantially identical to the first track member 59 and preferably has a C-shaped raceway 101 for reasons which will hereinafter become apparent. The specific construction of the second track member 95 may vary as will now be apparent to those skilled in the art. The second track member 95 preferably consists of a track portion of a typical over-head garage door assembly or the like.

The first track means 55 also preferably includes a second follower means 103 attached to the first side edge 41 of the platform member 35 a spaced distance behind the first follower means 67 (see FIG. 2) for being guided by the second track member 95 between the first and second ends 97, 99 thereof. The second follower means 103 is preferably substantially identical to the first follower means 67 and preferably includes a roller 105 for being rollably positioned, held and guided within the C-shaped raceway 101 of the second track member 95, a mounting bracket 107 for being fixedly attached to the top 37 of the platform member 35 adjacent the first side edge 41 thereof, and an axle 109 for joining the roller 105 to the mounting bracket 107. A spacer block 111 is preferably mounted between the mounting bracket 107 and the top 37 of the platform member 35 for spacing the top 37 of the platform member 35 below the axle 109, etc. The specific construction of the second follower means 103 may vary as will now be apparent to those skilled in the art. The second follower means 103 preferably consists of a standard follower means of a typical overhead garage door or the like.

The second track means 57 preferably includes a second track member 113 having a first end 115 for being attached to the underside 21 of the deck member 17 of the pontoon boat 13 substantially directly behind the first track member 77 (see FIG. 3) and having a second end 117. The first end 115 of the second track member 113 is preferably higher than the second end 117 thereof when attached to the underside 21 of the deck member 17. More specifically, the second track member 113 preferably includes a 90 degree bend between the first and second ends 115, 117 thereof whereby the first end 115 thereof is substantially horizontal and the second end 117 thereof is substantially vertical when the second track member 113 is attached to the underside 21 of the deck member 17 and the pontoon boat 13 is properly floating on the body 15 of water. The second track member 113 is preferably substantially identical to the first track member 77 and preferably has a C-shaped raceway 119 for reasons which will hereinafter become apparent. The specific construction of the second track member 113 may vary as will now be apparent to those skilled in the art. The second track member 113 preferably consists of a track portion of a typical over head garage door assembly or the like.

The second track means 57 also preferably includes a second follower means 121 attached to the second side edge 43 of the platform member 35 a spaced distance behind the first follower means 85 (see FIG. 3) for being guided by the second track member 113 between the first and second ends 115, 117 thereof. The second follower means 121 is preferably substantially identical to the first follower means 85 and preferably includes a roller 123 for being rollably positioned, held and guided within the C-shaped raceway 119 of the second track member 113, a mounting bracket 125 for being fixedly attached to the top 37 of the platform member 35 adjacent the second side edge 43 thereof, and an axle 127 for joining the roller 123 to the mounting bracket 125. A spacer block 129 is preferably mounted between the mounting bracket 125 and the top 37 of the platform member 35 for spacing the top 37 of the platform member 35 below the axle 127, etc. The specific construction of the second follower means 121 may vary as will now be apparent to those skilled in the art. The second follower means 121 preferably consists of a standard follower means of a typical overhead garage door or the like.

The specific manner of attaching the track members 59, 77, 95, 113 to the underside 21 of the deck member 17 may vary as will now be apparent to those skilled in the art. Preferably, the track members 59, 95 of the first track means 55 are fixedly attached by bolt means (not shown) or the like, to an elongated, rigid, metal angle 131 with the horizontal portions thereon located substantially end-to-end. In turn, the angle 131 is preferably fixedly attached by bolt means 133 or the like to an elongated, rigid, metal channel 135 which is fixedly attached by bolt means 137 or the like directly to the underside 21 of the deck member 17 of the pontoon boat 13 (see FIG. 4). Likewise, the track members 77, 113 of the second track means 57 are preferably fixedly attached by bolt means (not shown) or the like, to an elongated, rigid, metal angle 139 with the horizontal portions thereon located substantially end-to-end. In turn, the angle 139 is preferably fixedly attached by bolt means 141 or the like to an elongated, rigid, metal channel 143 which is fixedly attached by bolt mean 145 or the like directly to the underside 21 of the deck member 17 of the pontoon boat 13 (see FIG. 4). An elongated, rigid, metal angle 147 is preferably fixedly attached to and extends between the lower or second ends 63, 99 of the track members 59, 95 to add rigidity and strength thereto and to act as a positive stop for the raceways 65, 101 as will now be apparent to those skilled in the art. Likewise, an elongated, rigid, metal angle 149 is preferably fixedly attached to and extends between the lower or second ends 81, 117 of the track members 77, 113 to add rigidity and strength thereto and to act as a positive stop for the raceways 83, 119 as will now be apparent to those skilled in the art. As thus mounted to the deck member 17, each track member 59, 77, 95, 113 has a horizontal portion terminating at the first end 61, 79, 97, 115 thereof, a vertical portion terminating at the second end 63, 81, 99, 117 thereof, and a curved portion joining the horizontal and vertical portions.

The platform assembly 11 preferably includes stabilizing mean for stabilizing the platform member 35 when the platform member 35 is in the second or in-use position. The stabilizing means preferably includes an elongated, flexible first stabilizing member 151 having a first end 153 for being attached to the channel 135 and having a second end 155 for being attached to the platform member 35 adjacent the front end 45 and the first side edge 41 thereof. The first stabilizing member 151 may consist of an elongated, flexible chain, cable, or the like as will now be apparent to those skilled in the art. The stabilizing means preferably includes an elongated, flexible second stabilizing member 157 having a first end 159 for being attached to the channel 143 and having a second end 161 for being attached to the platform member 35 adjacent the front end 45 and the second side edge 43 thereof. The second stabilizing member 157 may consist of an elongated, flexible chain, cable, or the like as will now be apparent to those skilled in the art. Eyebolts 162 are preferably attached to the opposite corners of the front end 45 of the platform member 35 to allow the second ends 155, 161 of the respective stabilizing members 151, 157 to be tied thereto, etc., as will now be apparent to those skilled in the art. The first and second stabilizing members 151, 157 are preferably substantially taut when the platform member 35 is in the second, in-use position as shown in broken lines in FIG. 1 and in solid lines in FIG. 3 to help support the front end 45 of the platform member 35 and prevent the front end 4 of the platform member 35 from rotating downward past a substantially horizontal position, etc., as will now be apparent to those skilled in the art.

As will now be apparent to those skilled in the art, the platform member 35 can be easily moved from the first, stored position to the second, in-use position by merely sliding the platform member 35 forward along the horizontal portions of the track members 59, 77, 95, 113 and allowing gravity to force the platform member 35 down along the vertical portions of the track members 59, 77, 95, 113 as will now be apparent to those skilled in the art. Likewise, the platform member 35 can be easily moved from the second, in-use position back to the first, stored position by merely manually lifting the platform member 35 up along the vertical portions of the track members 59, 77, 95, 113 and pushing the platform member 35 back along the horizontal portions of the track members 59, 77, 95, 113 as will now be apparent to those skilled in the art. However, the platform assembly 11 preferably includes winch means 163 for moving the platform member 35 from the second position to the first position. The winch means 163 preferably includes a winch member 165 for being mounted on the top 19 and at or adjacent the front end 27 of the deck member 17 of the pontoon boat 13. The winch means 163 may consist of any typical manual or electric winch, etc., capable of moving the platform member 35 along the track means as will now be apparent to those skilled in the art. The winch means 163 includes cable means for extending between the winch member 65 and the platform member 35 and guide means for guiding the cable means between the winch member 165 and the platform member 35. The cable means preferably includes a first cable member 167 for extending between the winch member 165 and the first side edge 41 of the platform member 35, and a second cable member 169 for extending between the winch member 165 and the second side edge 43 of the platform member 35. Eyebolts 170 are preferably attached to the midportion of each side edge 41, 43 of the platform member 35 to allow one end of a respective cable member 167, 169 to be tied thereto, etc., as will now be apparent to those skilled in the art. The guide means preferably includes a first guide roller or sheave 171 and a second guide roller or sheave 173 for guiding the first cable member 167 between the winch member 165 and a point on the first side edge 43 of the platform member 35 substantially midway between the front and rear ends 45, 47 of the platform member 35. Likewise, the guide means preferably includes a third guide roller or sheave 175 and a fourth guide roller or sheave 177 for guiding the second cable member 169 between the winch member 165 and a point on the second side 43 of the platform member 35 substantially midway between the front and rear ends 45, 47 of the platform member 35.

Although the present invention has been described and illustrated with respect to a preferred embodiment and a preferred use therefor, it is not to be so limited since modifications and changes can be made therein which are within the full intended scope of the invention.

I claim:

1. A platform assembly for use with a body of water and a boat floating upon said body of water, said platform assembly comprising:

a) a platform member; said platform member having a first side and a second side; and b) track means for mounting said platform member to said boat and for allowing said platform member to move between a first position above said body of water and a second position adjacent said body of water; said track means including first track means for mounting said first side of said platform member to said boat; said track means including second track means for mounting said second side of said platform member to said boat; said first track means including a first track member for being attached to said boat, said first track member of said first track means having a first end and a second end; said first track means including a first follower means attached to said first side of said platform member for being guided by said first track member of said first track means between said first and second ends thereof; said first track means including a second track member for being attached to said boat, said second track member of said first track means having a first end and a second end; said first track means including a second follower means attached to said first side of said platform member a spaced distance from said first follower means of said first track means for being guided by said second track member of said first track means between said first and second ends thereof.

2. The platform assembly of claim 1 in which said second track means includes a first track member for being attached to said boat, said first track member of said second track means having a first end and a second end; in which said second track means includes a first follower means attached to said second side of said platform member for being guided by said first track member of said second track means between said first and second ends thereof; in which said second track means includes a second track member for being attached to said boat, said second track member of said second track means having a first end and a second end; and in which said second track means includes a second follower means attached to said second side of said platform member a spaced distance from said first follower means of said second track mean for being guided by said second track member of said second track means between said first and second ends thereof.

3. The platform assembly of claim 2 in which said first ends of said track members of said first and second track means are higher than said second ends thereof; said platform member being in said first position when said follower means of said first and second track means are positioned at said first ends of said track members of said first and second track means.

4. The platform assembly of claim 3 in which is included stabilizing means for stabilizing said platform when said platform is in said second position.

5. The platform assembly of claim 4 in which said stabilizing means includes a stabilizing member having a first end for being attached relative to said track means and having a second end for being attached to said platform member.

6. The platform assembly of claim, 4 in which said platform member includes a front end for extending outward of said boat when said platform member is in said second position.

7. The platform assembly of claim 6 in which said stabilizing means includes an elongated, flexible first stabilizing member having a first end for being attached relative to said track means and having a second end for being attached to said platform member adjacent said front end and said first side thereof: and in which said stabilizing means includes an elongated, flexible second stabilizing member having a first end for being attached relative to said track means and having a second end for being attached to said platform member adjacent said front end and said second side thereof; said first and second stabilizing members being taut when said platform member is in said second position.

8. The platform assembly of claim 3 in which said track members of said first and second track means have a track for guiding said follower means of said first and second track means respectively.

9. The platform assembly of claim 8 in which said track of each of said track members of said first and second track means has a horizontal portion terminating at said first end of each of said track members, has a vertical portion terminating at said second end of each of said track members, and has a curved portion joining said horizontal and vertical portions.

10. The platform assembly of claim 9 in which each of said follower means of said first and second track means includes a roller member for being rollably held and guided by said track of the respective one of each of said track members of said first and second track means.

11. The platform assembly of claim 10 in which is included winch means for moving said platform member from said second position to said first position.

12. The platform assembly of claim 11 in which said winch means includes a winch member for being mounted on said boat, cable means for extending between said winch member and said platform member, and guide means for guiding said cable means between said winch member and said platform member.

13. The platform assembly of claim 12 in which said cable means includes a first cable member for extending between said winch member and said first side of said platform member, and includes a second cable member for extending between said winch member and said second side of said platform member.

14. The platform assembly of claim 13 in which said platform member has a rear end; in which said guide means includes a first guide roller and a second guide roller for guiding said first cable member between said winch member and a point on said first side of said platform member midway between said front and rear ends of said platform member; and in which said guide means includes a third guide roller and a fourth guide roller for guiding said second cable member between said winch member and a point on said second side of said platform member midway between said front and rear ends of said platform member.

15. A platform assembly in combination with a pontoon boat for floating upon a body of water; said pontoon boat including a deck member having an underside, a first pontoon attached to and depending from one side edge of said deck member, and a second pontoon attached to and depending from the other side edge of the deck member; an open space being formed between said first and second pontoons, said underside of said deck member, and the surface of the body of water; said platform assembly comprising:

a) a platform member movable between a stored position and an in-use position; said platform member being located completely above the surface of the body of water and within the open space formed between said first and second pontoons, said underside of said deck member, and the surface of the body of water when in the stored position; said platform member being located adjacent the surface of the body of water and at least partly outward past said deck member when in the in-use position; said platform member having first side and a second side; and b) a first track having a first end attached to said underside of said deck and having a second end; said first end of said first track being higher than said second end of said first track;

c) a first track follower attached to said first side of said platform member and slidably mounted to said first track for movement between said first and second ends of said first track;

d) a second track having a first end attached to said underside of said deck and having a second end; said first end of said second track being higher than said second end of said second track; and e) a second track follower attached to said second side of said platform member and slidably mounted to said second track for movement between said first and second ends of said second track; said platform member being in said stored position when said first and second track followers are positioned at said first ends of said first and second tracks, respectively.

16. The combination of claim 15 in which said platform assembly includes:

f) a third track having a first end attached to said underside of said deck and having a second end; said first end of said third track being higher than said second end of said third track;

g) a third track follower attached to said first side of said platform member a spaced distance from said first track follower and slidably mounted to said third track for movement between said first and second ends of said third track;

h) a fourth track having a first end attached to said underside of said deck and having a second end; said first end of said fourth track being higher than said second end of said fourth track; and i) a fourth track follower attached to said second side of said platform member a spaced distance from said second track follower and slidably mounted to said fourth track for movement between said first and second ends of said fourth track.

* * * * *